US005615644A

United States Patent [19]

Nuti

[11] Patent Number: 5,615,644

[45] Date of Patent: Apr. 1, 1997

[54] VALVE ARRANGEMENT IN AN INTERNAL COMBUSTION ENGINE

[75] Inventor: Marco Nuti, Pisa, Italy

[73] Assignee: Piaggio Veicoli Europei S.p.A., Pisa, Italy

[21] Appl. No.: 633,381

[22] Filed: Apr. 17, 1996

[30] Foreign Application Priority Data

Jun. 20, 1995 [IT] Italy ..... MI95A1318

[51] Int. Cl.[6] ..... F02B 75/02

[52] U.S. Cl. ..... 123/65 VB; 123/68; 123/188.2

[58] Field of Search ..... 123/68, 70 R, 123/71 R, 65 VB, 188.17, 188.2

[56] References Cited

U.S. PATENT DOCUMENTS 2,150,185 3/1939 Phillips ..... 123/65 VB
2,249,354 7/1941 Gehres ..... 123/65 VB
2,252,187 8/1941 Kylen ..... 123/65 VB
2,334,688 11/1943 Norton ..... 123/65 VB
4,345,897 9/1994 Linder et al. ..... 123/65 VB

*Primary Examiner*—David A. Okonsky
*Attorney, Agent, or Firm*—Diller, Ramik & Wight, PC

[57] ABSTRACT

A valve arrangement in an internal combustion engine, into which engine the air-fuel mixture is directly injected by relative pumping elements from a pressure chamber towards at least one cylinder provided with a valve aperture with its relative valve located within a valve body provided with at least one communication channel, between the valve and the valve aperture there being positioned an elastic element which when at rest maintains the valve in its closed position, the valve being inserted into said valve body by way of interposed elements, lockable in their selected position, for adjusting both the preload and its travel.

7 Claims, 2 Drawing Sheets

12
15
14
18
16
17
13
19
23
22
11
21
20

VALVE ARRANGEMENT IN AN INTERNAL COMBUSTION ENGINE

BACKGROUND OF THE INVENTION

This invention relates to a valve arrangement in an internal combustion engine.

Injection systems or units for fuel or air-fuel mixtures are becoming increasingly more used. Their development is particularly great in applications directed towards reducing emissions of pollutant substances, by facilitating the formation of stratified mixtures in the combustion chamber.

In view of these developments and their associated problems, cylinder head arrangements with a suitably inserted combined pump or similar device have been under development for internal combustion engines for some time. In this manner an air-fuel mixture is prepared within the combustion chamber and then directly injected into it. An example of such a cylinder head is illustrated in European patent EP-B-0514982 in the name of the present applicant.

As such a pump is of positive displacement type it is extremely important to reduce clearance volumes. In this respect, clearance volumes result in a reduction in the final pressure achieved and an insufficient change of the internal charge.

Arrangements identical to or of the same type as the aforesaid have the drawback of a certain bulk and complicated construction and assembly.

In other fields such as the field of medium-high pressure injectors for liquids, valves of a certain simplicity have been developed. These valve constructions, known as popper valves, have given little attention to the problem of bulk, seeing that they are for liquids. As clearance volumes are not a problem, these have in no respect been considered, with the result that the valve arrangements are very bulky, particularly in the valve axial direction. Consequently such arrangements cannot be used in engines, given the requirement of extreme compactness with elimination of clearance volumes.

Further problems present in the valves of current internal combustion engines are flameproofing and the ease of construction and industrial application, also in relation to the adjustment and setting of installed valves.

SUMMARY OF THE INVENTION

In view of all these problems, an object of the present invention is to reduce to a minimum the dimensions of the injection valve, ie the valve interposed between the pump pressure chamber and the combustion chamber.

A further object of the present invention is to provide a valve arrangement of considerable simplicity in terms of assembly, construction and setting.

A further object is to provide a valve arrangement in which clearance volumes are minimized.

These and further objects are attained according to the present invention by a valve arrangement in an internal combustion engine, into which engine the air-fuel mixture is directly injected by relative pumping elements from a pressure chamber towards at least one cylinder provided with a valve aperture with its relative valve located within a valve body provided with at least one communication channel, between the valve and the valve aperture there being positioned an elastic element which when at rest maintains said valve in its closed position, characterised in that said valve is inserted into said valve body by way of interposed elements, lockable in their selected position, for adjusting both the preload and its travel.

The characteristics and advantages of a valve arrangement in an internal combustion engine according to the present invention will be more apparent from the following description given by way of non-limiting example with reference to the accompanying schematic drawings in which:

DESCRIPTION OF THE PREFERRED EMBODIMENTS

Figure 1:
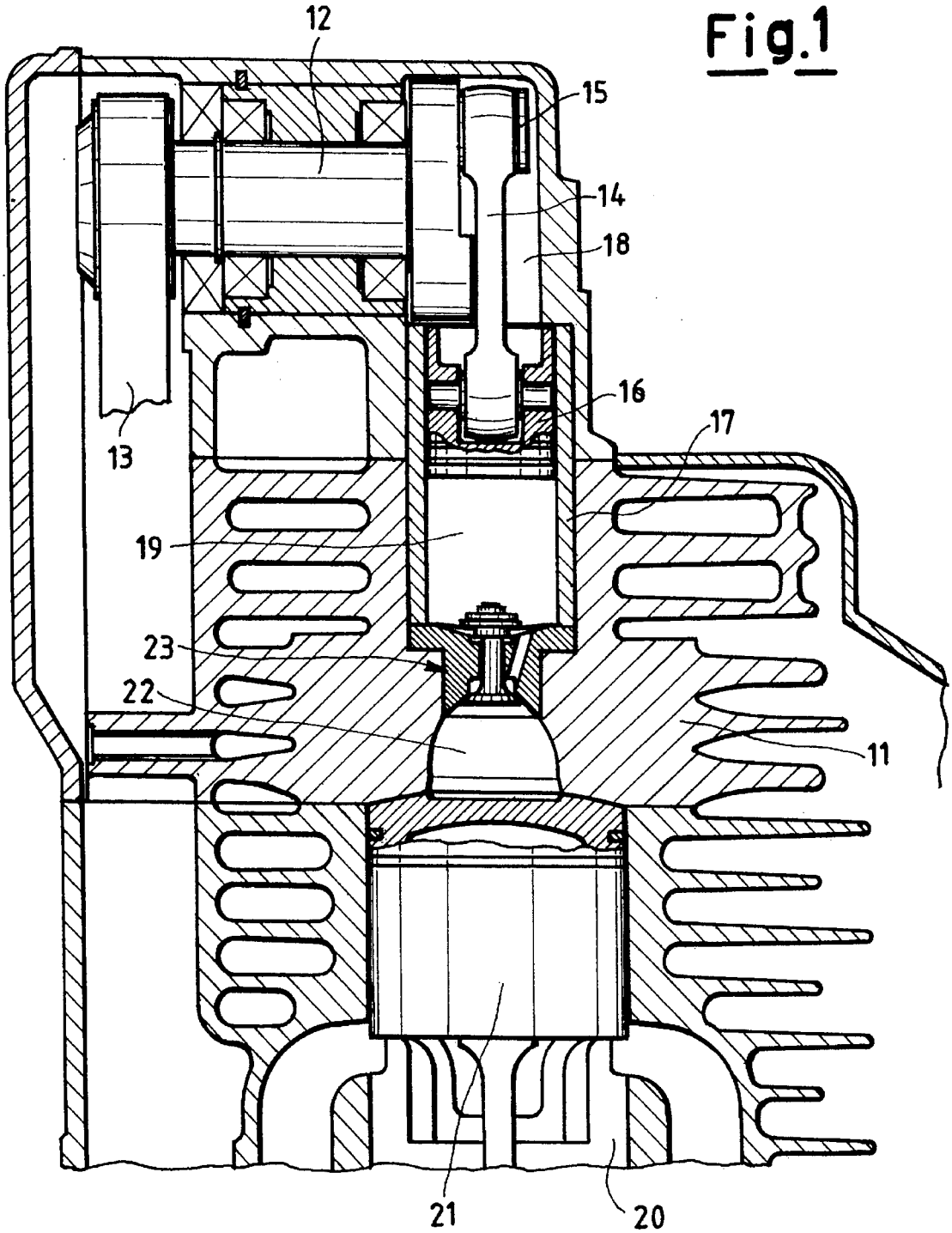
FIG. 1 is a partial section through an internal combustion engine cylinder head provided with an advantageous valve arrangement according to the present invention.

FIG. 1 shows a cylinder head 11 of an internal combustion engine in which a shaft 12, driven by a toothed belt 13, operates a connecting rod 14 pivoted eccentrically at 15 onto it. The connecting rod 14 is connected to an injection piston 16 which, sliding within a jacket 17, is able to inject the air-fuel mixture generated in a first chamber 18 and transferred into an underlying pressure chamber 19, for example via suitable transfer ports (not shown in the figures).

The pressure chamber 19 communicates via a valve arrangement 23 according to the present invention with the combustion chamber 22 of a cylinder 20 housing a piston 21, shown at its top dead centre.

Such a cylinder head is similar to that of said European patent EP-B-0514982 of the present applicant, with the exception of the valve arrangement which is the subject of the present invention.

Figure 2:
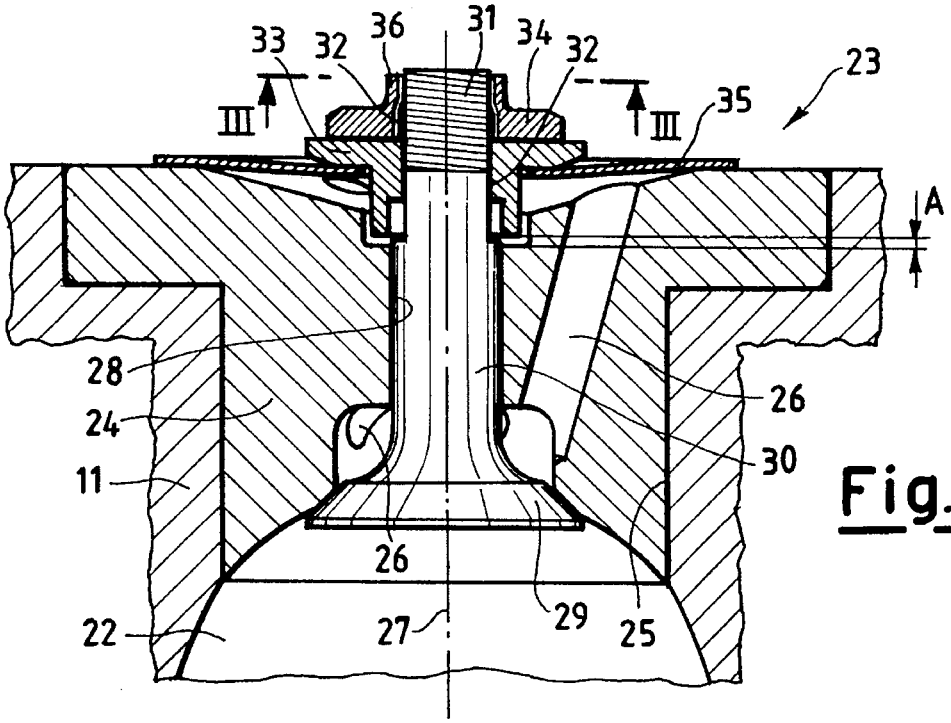
FIG. 2 is an enlarged section showing just the inventive valve arrangement of FIG. 1.

FIG. 2 shows an enlarged section through the valve arrangement of the invention, indicated overall by 23.

A valve body 24 is located at the end of the pressure chamber 19 lined with the jacket 17, in an aperture 25 provided in the cylinder head 11. One or more channels 26, for example extending inclined to the axis 27 of movement of the valve, are provided within the valve body 24 to connect the pressure chamber 19 to the combustion chamber 22.

A valve 29, comprising according to the present invention a threaded end portion 31 on its stem 30, is housed in the valve body 24 in a suitable through hole 28. This end portion also comprises two facets 32 in the illustrated embodiment. On the stem 30 there is located a centrally holed first cap 33, this hole being provided with facets for prismatic engagement on the stem 30. A further centrally holed second cap 34, the hole of which is provided with a thread, is screwed onto the thread 31 of the stem 30 to abut onto the first cap 33.

A flat spring 35 is arranged between the valve body 24 and a widening flange of the first cap 33, and acts between the two. The flat spring 35 is either of small transverse dimension or comprises through apertures, to allow communication between the pressure chamber 19 and the combustion chamber 22.

It should be noted that when the parts have been mounted in the described succession, the second cap 34 can be rotated about the thread 31 to achieve the required preload of the flat spring 35.

In this manner the desired delivery pressure can be set and optimized and the valve 29 travel A can be determined, its travel terminating with the cap abutting on the valve body 24 or on the base of an aperture provided in the valve body or on its upper surface.

Figure 3:
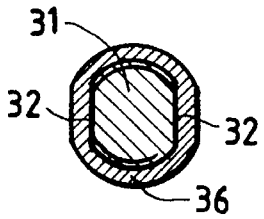
FIG. 3 is a section on the line III—III of FIG. 2.
Figure 4:
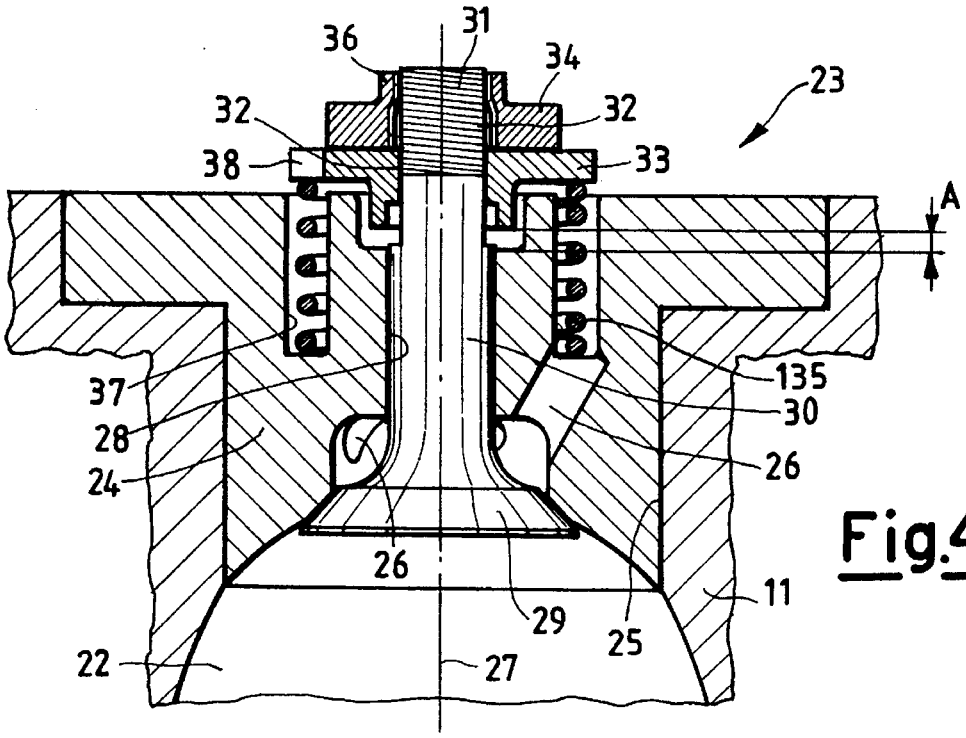
FIG. 4 is a further embodiment of the valve arrangement shown in enlarged section.

According to the present invention, having made the desired settings and achieved optimum operation, the rotational movement of the second cap 34 about the stem 30 can be locked. This is achieved by clinching, ie by deforming and flattening a collar 36 on the surface of the second cap 34 onto the facets 32 of the end of the stem 30 of the valve 29, so preventing mutual rotation. FIG. 3 clearly shows in section this operation accomplished. FIG. 4 shows a second embodiment of a valve arrangement according to the invention. For ease of understanding, identical parts are indicated by identical reference numerals.

A substantially equivalent arrangement is shown using a helical spring 135 housed in a recessed annular seat 37 provided in the valve body 24 coaxial to the axis 27.

In this case the channel or channels 26 are of limited length and lead into the seat 37 for the spring.

In the widening flange of the first cap 33 there are provided interruptions or apertures 38 which again allow communication between the pressure chamber 19 and the combustion chamber 22.

In this manner it is possible to accurately choose the best operational setting for the valve, while maintaining an extremely small overall size for the arrangement of component parts.

An arrangement according to the present invention is also of considerable interest in terms of its production on an industrial scale.

Although a preferred embodiment of the invention has been specifically illustrated and described herein, it is to be understood that minor variations may be made in the apparatus without departing from the spirit and scope of the invention, as defined the appended claims.

I claim:

1. A valve arrangement in an internal combustion engine, into which engine the air-fuel mixture is directly injected by relative pumping elements from a pressure chamber towards at least one cylinder provided with a valve aperture with its relative valve located within a valve body provided with at least one communication channel, between the valve and the valve aperture there being positioned an elastic element which when at rest maintains said valve in its closed position, characterised in that said valve is inserted into said valve body by way of interposed elements, lockable in their selected position, for adjusting both the preload and its travel.

2. An arrangement as claimed in claim 1, characterised in that said adjustment elements comprise at least one threaded portion on a stem of said valve and at least one cap provided with a complementarily threaded central hole and lockable onto said stem in the desired position relative thereto.

3. An arrangement as claimed in claim 2, characterised in that said at least one cap is lockable into said stem in a prechosen position by clinching.

4. An arrangement as claimed in claim 1, characterised by comprising a pair of centrally holed caps mountable on a stem of said valve, of which a first cap, movable axially but not rotationally, directly faces said elastic element, the second cap being provided with a threaded hole and screwable onto a complementarily threaded portion of said valve stem, said pair of caps abutting one on the other and at least one being lockable on said stem.

5. An arrangement as claimed in claim 4, characterised in that said axially but not rotationally movable first cap is positioned on a portion of said stem on facets formed on said threaded portion.

6. An arrangement as claimed in claim 1, characterised in that said elastic element is a flat spring.

7. An arrangement as claimed in claim 1, characterised in that said elastic element is a helical spring.

* * * * *